US005175896A

United States Patent [19]

Zamir

[11] Patent Number: 5,175,896

[45] Date of Patent: Jan. 5, 1993

[54] BATHROOM ACCESSORY

[76] Inventor: Amos Zamir, 3 Hasavoraim St., Neve Avivim, 69207 Tel Aviv, Israel

[21] Appl. No.: 721,072

[22] Filed: Jun. 26, 1991

[30] Foreign Application Priority Data

Jun. 29, 1990 [IL] Israel ..... 94916

[51] Int. Cl.[5] ..... A47K 7/03

[52] U.S. Cl. ..... 4/606; 4/559; 15/160; 15/210.1

[58] Field of Search ..... 4/606, 605, 559; 15/114, 210 R, 160

[56] References Cited

U.S. PATENT DOCUMENTS

| | | | |
|---|---|---|---|
| 1,954,940 | 4/1934 | Mikel | 15/160 X |
| 3,040,337 | 6/1962 | Fjelstad | 4/559 |
| 3,055,037 | 9/1962 | Fjelstad | 15/210 R |
| 3,180,342 | 4/1965 | Dietsche | 15/160 |
| 3,612,044 | 10/1971 | Gurrola | 4/559 X |
| 3,631,560 | 1/1972 | Atkins | 4/606 X |
| 3,750,226 | 8/1973 | Morgan | 4/606 X |
| 4,003,372 | 1/1977 | Willoby | 4/606 X |
| 4,184,221 | 1/1980 | Edwards | 15/210 R X |
| 4,417,362 | 11/1983 | Walker | 4/606 |
| 4,699,127 | 10/1987 | Schley | 4/606 X |
| 4,704,759 | 11/1987 | Mesa | 4/606 X |
| 4,890,352 | 1/1990 | Stowers et al. | 4/606 X |
| 4,943,018 | 7/1990 | Glaser et al. | 4/606 X |
| 5,072,480 | 12/1991 | Peters et al. | 4/606 X |

FOREIGN PATENT DOCUMENTS

| | | | |
|---|---|---|---|
| 0805691 | 5/1951 | Fed. Rep. of Germany | 15/160 |
| 2215037 | 10/1973 | Fed. Rep. of Germany | 4/559 |
| 2123281 | 2/1984 | United Kingdom | 15/160 |
| 2209933 | 6/1989 | United Kingdom | 15/210 R |
| 2216000 | 10/1989 | United Kingdom | 15/210 R |

*Primary Examiner*—William A. Cuchlinski, Jr.
*Assistant Examiner*—John L. Beres
*Attorney, Agent, or Firm*—Benjamin J. Barish

[57] ABSTRACT

A bathroom accessory includes a base member; suction cups on one face of the base member for removably mounting the accessory to a mounting surface, such as the wall of a shower or the wall of or adjacent to a bathtub; a plurality of projections projecting from the opposite face of the base member for massaging the back of user when the accessory is mounted to the mounting surface; and a flexible back-cleaning pad removably attached to cover the outer tips of at least some of the projections for cleaning the back of the user.

14 Claims, 2 Drawing Sheets

FIG. 1
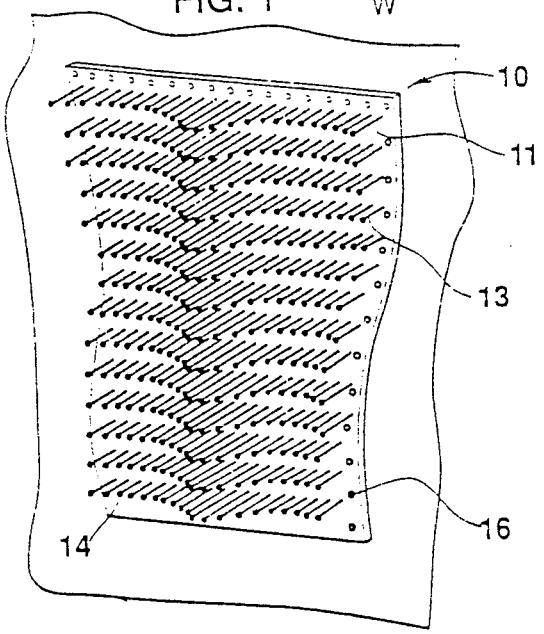
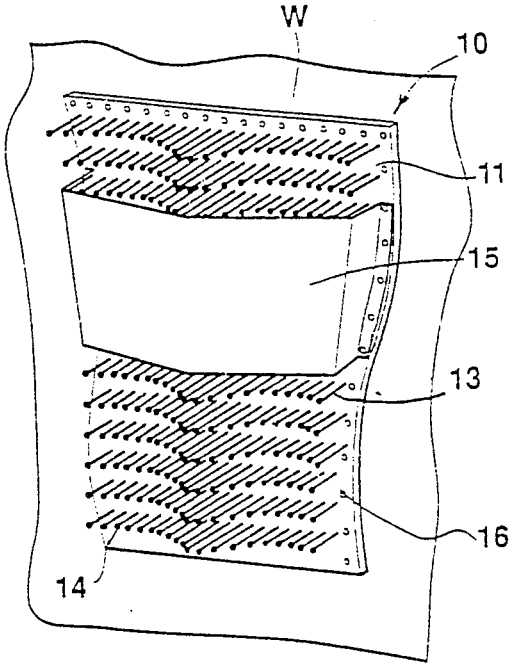
FIG. 2
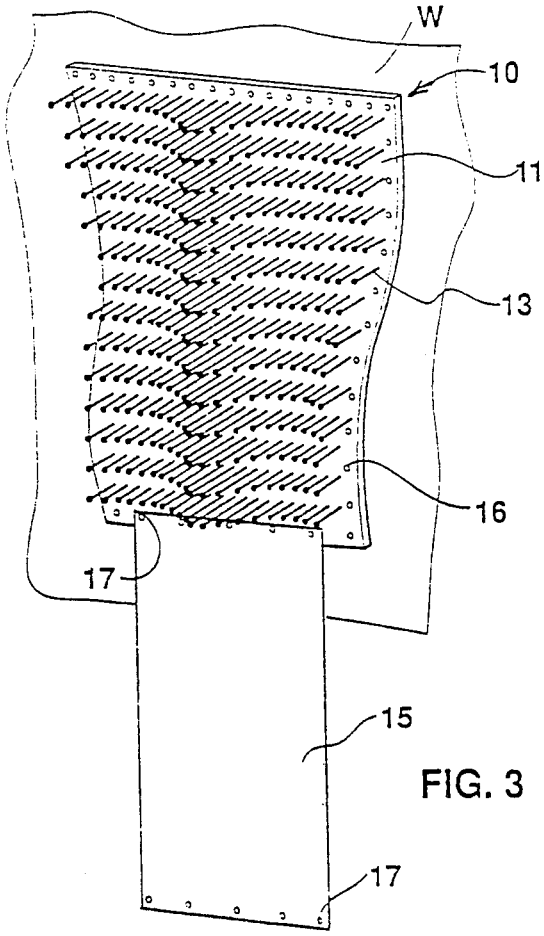
FIG. 3
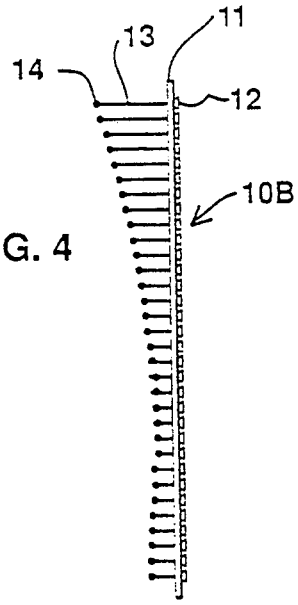
FIG. 4

BATHROOM ACCESSORY

FIELD AND BACKGROUND OF THE INVENTION

The present invention relates to a bathroom accessory, and particularly to such an accessory which may be applied to the shower or bathtub wall for use in massaging, scratching, and cleaning the back of a user.

When taking a shower or bath, substantial portions of the person's back are not conveniently accessible to the person. As a result, if a person does not use a brush, which most people find inconvenient, a substantial part of the person's back will frequently be only rinsed but not actually washed.

A number of devices have been described in the patent literature for washing and also massaging a person's back. Examples of patents describing such devices are U.S. Pat. No. 3,289,215, 3,478,369, 3,577,985, 3,750,226, 4,020,519, 4,040,132, 4,417,362, 4,696,068, 4,699,127, 4,704,759, 4,759,091 and 4,890,352.

OBJECTS AND BRIEF SUMMARY OF THE INVENTION

An object of the present invention is to provide another type of bathroom accessory having a number of advantages over the known types as will be described more particularly below.

According to the present invention, there is provided a bathroom accessory comprising: a base member; mounting means on one face of the base member for removably mounting the accessory to a mounting surface, such as the wall of a shower or the wall of or adjacent to a bathtub; a back massaging device including a plurality of projections projecting from the opposite face of the base member for massaging the back of a user when the accessory is mounted to the mounting surface; and a flexible back-cleaning pad removably attached to the accessory and covering the outer tips of only some of the projections for cleaning the back of the user.

According to further features in the preferred embodiments of the invention described below, the flexible back-cleaning pad is a sheet of sponge material and is attached to the margins of the base member by clasps or by "Velcro" (Reg. T.M.) hook and loop fastener strips.

According to further features in the described preferred embodiments, the mounting means comprises suction cups projecting from the one face of the base member.

A bathroom accessory constructed in accordance with the foregoing features may be conveniently mounted to the wall of the shower, or to the wall of or adjacent to a bathtub, and used for massaging and also for cleaning the back of the person taking the shower or bath. The accessory is easily attachable to the shower or bathroom wall at different heights for use by different family members. It not only obviates the need for a brush to wash the back, but also frees both hands while washing or massaging the user's back. Moreover, since the flexible back-cleaning pad is removably attached to cover the outer tips of only some of the projections, the accessory may be used not only for massaging the user's back, but also for cleaning the user's back at the same time.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view illustrating one form of bathroom accessory constructed in accordance with the present invention, but with the flexible back-cleaning pad removed;

FIG. 2 illustrates the accessory of FIG. 1 with the flexible back-cleaning pad applied;

FIG. 3 illustrates the accessory of FIG. 2 with the flexible back-cleaning pad of FIG. 2 in its condition after us to facilitate drying;

FIG. 4 is a side elevational view illustrating the accessory of FIGS. 1–3 with the flexible back-cleaning pad removed;

DESCRIPTION OF PREFERRED EMBODIMENTS

Figure 5:
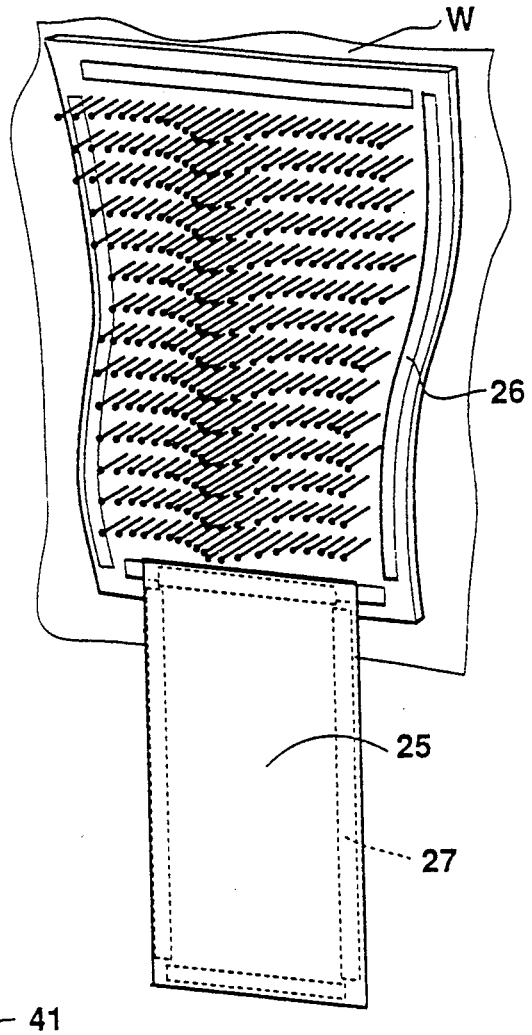
FIG. 5 is a view similar to that of FIG. 3 but illustrating a modification in the construction.

The bathroom accessory illustrated in FIGS. 1–4, and therein generally designated 10, comprises a base member 11 having a plurality of suction cups 12 (FIG. 4) projecting from one face (constituting its rear face) for mounting the accessory to a mounting surface, such as the wall W of a shower or of a bathtub. The opposite face of base member 11 carries a plurality of projections 13, which may be used for massaging or cleaning the back of the user when the accessory is mounted in the shower or bathtub.

Base member 11 may be of any suitable plastic material, such as polyvinyl chloride, polyurethane, natural or synthetic rubber, or the like. Preferably, it is integrally formed with the suction cups 12 on its rear face and with the projections 13 on its front face. The outer tips of the projections 13 may, if desired, be enlarged and rounded, as shown at 14. These projections are preferably of uneven lengths such that their tips define a curved contour, e.g., in the general shape of a person's back.

The illustrated accessory, as shown particularly in FIG. 2, further includes a flexible, back-cleaning pad 15 removably attached to the base member 11 and covering the outer tips of its projections 13. Pad 15, for example, may be a body or sheet of sponge rubber, material or synthetic. It is formed with clasps 16 along opposite its sides receivable within mating clasps or snaps 17 carried at the margins of the base member 11 for removably supporting the pad either in its operative position (FIG. 2) over the outer tips of the projections 13, or in a drying position (FIG. 3) suspended below the base member 11.

Instead of using mating clasps 16, 17 for detachably securing the pad to the base member, other fastener means may be used. FIG. 5 illustrates a pad 25 using "Velcro"(Reg. T.M.) hook and loop fastener strips 26, 27, respectively, for this purpose.

Figure 6:
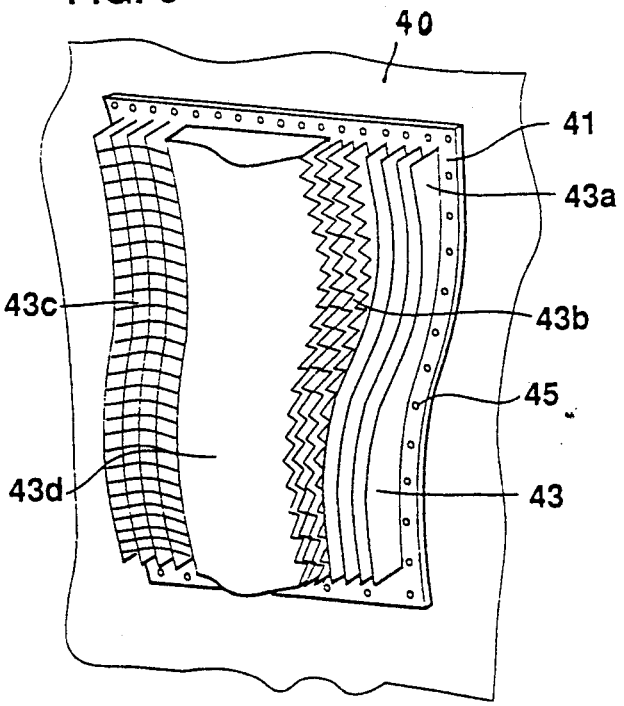
FIG. 6 illustrates a further form of accessory constructed in accordance with the invention with the flexible back-cleaning pad removed.

FIG. 6 illustrates a further construction of bathroom accessory generally designated 40. This accessory includes a base member 41 integrally formed on its rear surface with a plurality of suction cups (corresponding to suction cups 12 in FIG. 4) to permit the accessory to be easily and removably attached to a wall of the shower, or to the wall of a bathtub. The front face of the accessory 40 illustrated in FIG. 6 is formed with a plurality of strips 43 of stiff material mounted in parallel spaced relation. Preferably, the strips 43 are integrally formed with the base member 41 and of the same material as the base material. The outer border of the base strip 41 may be also formed with a plurality of clasps 45 (or with the "Velcro" strips 26, 27, FIG. 5) for removably receiving a pad, corresponding to pad 15 of FIGS. 2 and 3 or 25 of FIG. 5.

The stiff strips 43 formed on the front face of the accessory 40 may be of various configurations. Thus, the illustrated strips include continuous strips 43*a* having curved outer edges together defining a curved contour, e.g., the shape of a back, and continuous strips 43*b* having corrugated outer edges producing the projections which enhance the massaging effect when the user moves the user's back relative to the accessory mounted to the shower or bathtub wall.

Accessory 40 illustrated in FIG. 6 further includes stiff strips extending in parallel relationship in both the vertical and horizontal axes to define an egg crate construction, as shown at 43*c*. Accessory 40 further includes a thickened strip 43*d* of sponge material also serving as a pad for cleaning the back, between the stiff strips 43*b*, 43*c*.

While the accessory 40 illustrated in FIG. 6 includes all the foregoing types of massaging and cleaning strips, it will be appreciated that the accessory could include only a single one of such types, or other combinations of such types.

In the FIG. 6 embodiment, the mounting face of the backing sheet (41) would also be formed with vacuum cups or the like, corresponding to vacuum cups 12 in the FIGS. 1-4 embodiment, for removably attaching the accessory to the shower or bathroom wall.

While the invention has been described with respect to a number of preferred embodiments, it will be appreciated that these are set forth merely for purposes of example, and that many other variations, modifications and applications of the invention may be made.

What is claimed is:

1. A bathroom accessory, comprising:

a base member;

mounting means on one face of the base member for removably mounting the accessory to a mounting surface, such as the wall of a shower or the wall of or adjacent to a bathtub;

a back massaging device including a plurality of projections projecting from the opposite face of the base member for massaging the back of a user when the accessory is mounted to the mounting surface;

and a flexible back-cleaning pad removably attached to said accessory and covering the outer tips of only some of said projections for cleaning the back of the user.

2. The accessory according to claim 1, wherein said flexible back-cleaning pad is a sheet of sponge material extending over the outer tips of said projections.

3. The accessory according to claim 1, wherein said flexible back-cleaning pad is removably attached to margins of the base member such as to permit the pad to be suspended from one margin to thereby expose all the projections of the massaging device.

4. The accessory according to claim 1, wherein said flexible back-cleaning pad is attached to margins of the base member by clasps.

5. The accessory according to claim 1, wherein said flexible back-cleaning pad is attached to margins of the base member by hook and loop fastener strips.

6. The accessory according to claim 1, wherein said mounting means comprises suction cups projecting from said one face of the base member.

7. The accessory according to claim 1, wherein said base member is made of a flexible plastic sheet.

8. The accessory according to claim 7, wherein said projections are integrally formed of plastic with said base member.

9. The accessory according to claim 8, wherein said projections are of uneven lengths such that their tips define a curved contour.

10. The accessory according to claim 9, wherein said projections are in the form of bristles terminating in enlarged rounded tips.

11. The accessory according to claim 1, wherein said projections include a plurality of strips of stiff material mounted in parallel spaced relation to said opposite face of the base member.

12. The accessory according to claim 11, wherein said plurality of strips of stiff material have curved outer edges defining a curved contour.

13. The accessory according to claim 11, wherein said plurality of strips of stiff material have corrugated outer edges.

14. The accessory according to claim 11, wherein said plurality of strips of stiff material define an egg crate construction.

* * * * *